US005388564A

United States Patent [19]

Islas

[11] Patent Number: 5,388,564

[45] Date of Patent: Feb. 14, 1995

[54] COMPOUND BOW

[76] Inventor: John J. Islas, 6980 Lincoln Knolls North, Canastota, N.Y. 13032

[21] Appl. No.: 178,526

[22] Filed: Jan. 5, 1994

[51] Int. Cl.[6] ..... F41B 5/10

[52] U.S. Cl. ..... 124/25.6; 124/23.1; 124/900

[58] Field of Search ..... 124/23.1, 24.1, 25.6, 124/86, 88, 900

[56] References Cited

U.S. PATENT DOCUMENTS

| | | | |
|---|---|---|---|
| 3,967,609 | 7/1976 | Frydenlund | 124/25.6 |
| 3,987,777 | 10/1976 | Darlington | 124/25.6 |
| 4,077,385 | 3/1978 | Fredrickson | 124/25.6 |
| 4,287,867 | 9/1981 | Islas | 124/25.6 |
| 4,757,799 | 7/1988 | Bozek | 124/25.6 |
| 4,858,588 | 8/1989 | Bozek | 124/25.6 X |
| 5,054,463 | 10/1991 | Colley et al. | 124/25.6 |
| 5,353,777 | 10/1994 | Fincher | 124/25.6 X |

*Primary Examiner*—Eric K. Nicholson
*Assistant Examiner*—John A. Ricci
*Attorney, Agent, or Firm*—Trapani & Molldrem

[57] ABSTRACT

A compound archery bow has limbs on upper and lower ends of a medial riser and a bowstring extends between outer ends of the limbs. A resilient power limb portion is cantilevered in the end of the riser. A rigid outer limb portion is affixed into a cam pulley that pivots on the free end of the power limb. Synchronizing pulleys disposed at ends of the riser are connected by a synchronizing cable. A cam cable extends from the respective end of the riser and rides in a cam groove on the cam pulley, with the cam cable being reeved in the pulley. A link member is coupled from a fixed point with respect to the cam pulley to the associated synchronizing wheel. The link member can be a rigid connecting rod or can be a reflex cable.

8 Claims, 2 Drawing Sheets

COMPOUND BOW

BACKGROUND OF THE INVENTION

This invention relates to an improved compound bow of the type employing cams and control cables to achieve a programmed draw weight that varies in a selected fashion as a function of draw length.

The invention is more particularly concerned with a compound bow in which the cam is interposed between an inboard spring limb member and an outboard rigid limb member.

A number of archery bows have been proposed in which programming means are incorporated to regulate the draw weight of the bow so that a maximum pull weight is attained at an intermediate draw position and a reduced draw weight is attained at full draw. These are typically referred to as compound bows. A number of these compound bows are described in U.S. Patent literature, namely Allen U.S. Pat. No. 3,486,495; Hofmeister U.S. Pat. No. 3,854,417; Trotter U.S. Pat. No. 3,923,035; Islas U.S. Pat. No. 3,981,290; and Islas U.S. Pat. No. 4,287,867.

The later patent, i.e., Pat. No. 4,287,867 describes a compound bow in which, on upper and lower ends of the riser, and outer rigid limb member is pivotally supported at its midsection on the outboard end of the cantilevered spring limb arm or power limb. A rotatable cam is pivotally supported on the riser, and a control cable which is received to the cam is connected at one end to the outer end of the spring limb arm and at the other end to the inboard end of the rigid limb member. The bowstring is strung between the outboard ends of the upper and lower rigid members. A synchronizing cable runs between upper and lower synchronizing wheels that turn with the rotatable cams.

Drawing the bow string rotates the outer limb member and flexes the spring limb arm. The control cable rotates the cam, and the profile of the cam programs the draw weight as a function of draw length. The draw weight varies non-linearly over the draw length and drops off somewhat at full draw, with full draw weight being achieved a short distance ahead of full draw.

While this compound bow design has proven to be quite successful, it has been desired to create a compound bow with still fewer parts, of lighter weight and smaller profile, and which has excellent draw weight characteristics.

OBJECTS AND SUMMARY OF THE INVENTION

It is an object to provide a compound archery bow that functions with a reduced number of parts, and an improved programmability of draw weight-to-displacement characteristic, and which avoids the drawbacks of prior art bows.

According to an aspect of the invention, the bow riser has spring power limbs cantilevered at its ends, respective cam pulleys pivotally mounted on outboard ends of the respective power limbs, and rigid limb members affixed to the cam pulleys. The bowstring extends between the ends of the two rigid limb members. A flexible, but inextensible cable runs from the end of the riser and passes over a peripheral cam groove of the cam pulley. An end of the cable is reeved in the cam pulley. A link member, which can be a reflex cable in one embodiment, and can be a rigid rod in another embodiment, is coupled at one end to an outer point fixed with respect to the cam pulley and outer limb, and is coupled at its other end to the synchronizing pulley or wheel.

The above and many objects, features, and advantages of this invention will present themselves to those skilled in the art from the ensuing description of selected preferred embodiments, to be read in conjunction with the accompanying Drawing.

DESCRIPTION OF THE PREFERRED EMBODIMENT

Figure 1:
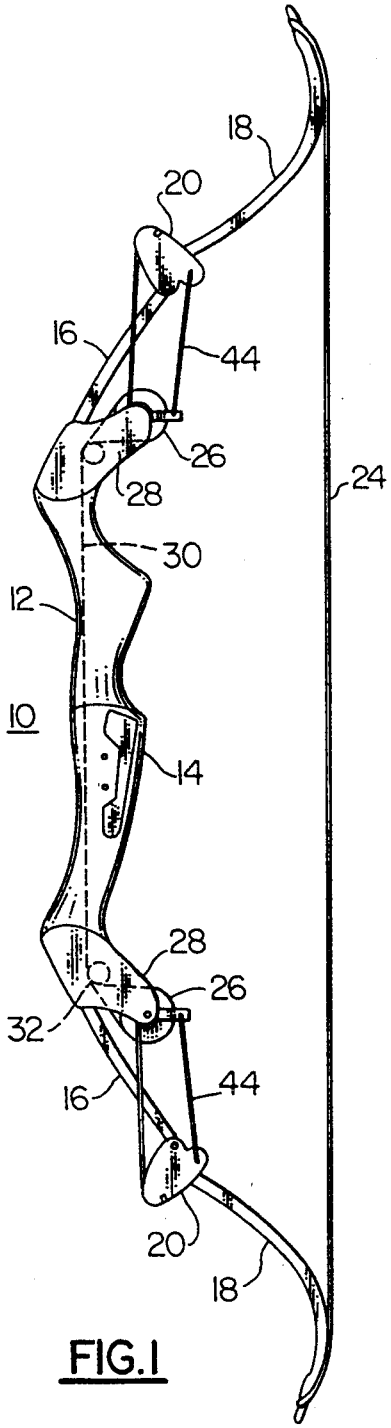
FIG. 1 is a side elevation of a compound bow according to one embodiment of this invention.

With reference to the Drawing, FIG. 1 shows a compound bow 10 of the present invention, which has a rigid elongated riser 12 or center portion. The bow 10 is considered in its conventional upright orientation, or shooting position.

Figure 2:
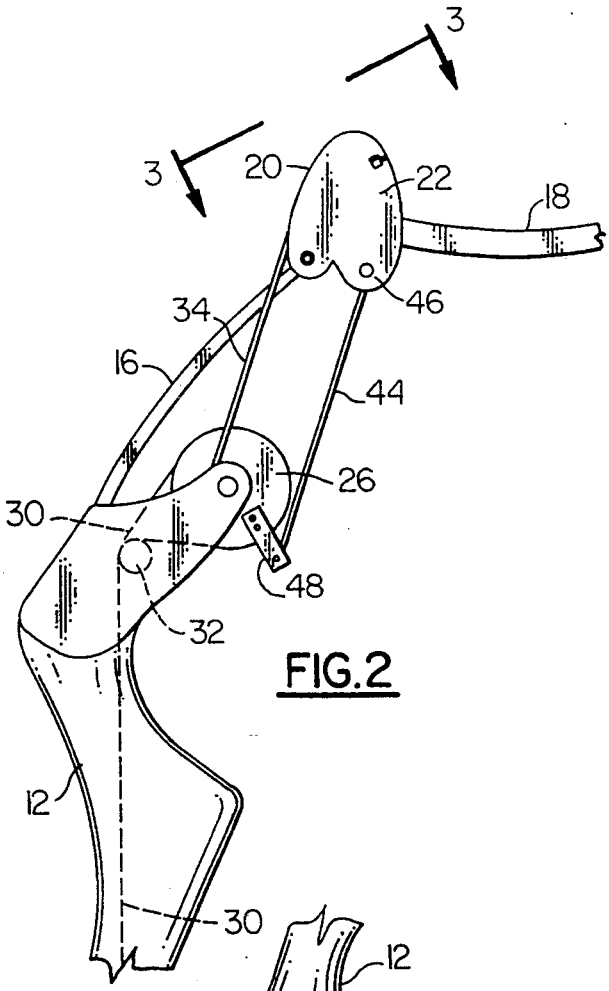
FIG. 2 shows an upper portion of this embodiment of the invention, in a drawn position.

The riser 12 has a handle or grip portion 14 formed on it. A belly side of the riser faces the archer (on the right in this view) and a back side faces the target (on the left here). Attached at upper and lower ends of the riser are the link portions. At each end of the riser 12, a power limb 16 or spring lever is cantilevered. A rigid outer limb 18 is affixed to a respective cam pulley 20 that is pivoted on the free end of the associated power limb 16. Here, each of the cam pulleys 20 is formed of a pair of cam plates 22, only one of which, per cam pulley, is shown in FIGS. 1 and 2, but both of which appear in FIG. 3. The cam pulley plates 22 are disposed on right and left sides of the bow 10, and have the same profiles.

A bowstring 24 is attached to the outer ends of the two outer limbs 18.

Synchronizing pulleys 26 are pivoted in upper and lower protuberances 28 at the ends of the riser 12. A continuous synchronizing cable 30, which is reeved to the synchronizing pulleys 26, passes over idler wheels 32 and through a vertical cable passage in the riser 12. The action of the synchronizing pulley and cable is well understood, and ensures even flexing of the upper and lower limbs.

Figure 3:
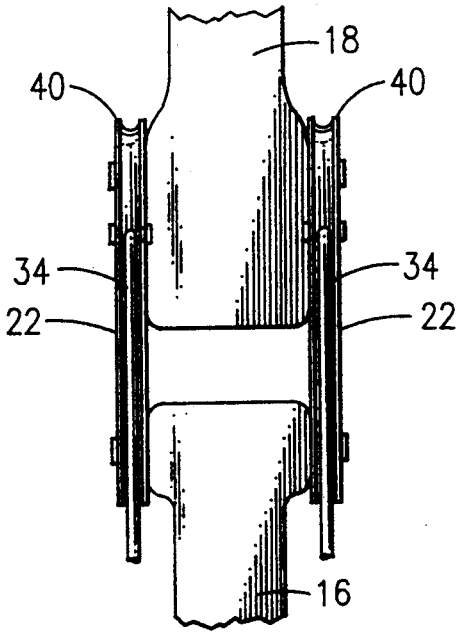
FIG. 3 is a top view of a cam pulley of this embodiment, taken at 3—3 of FIG. 2.
Figure 4:
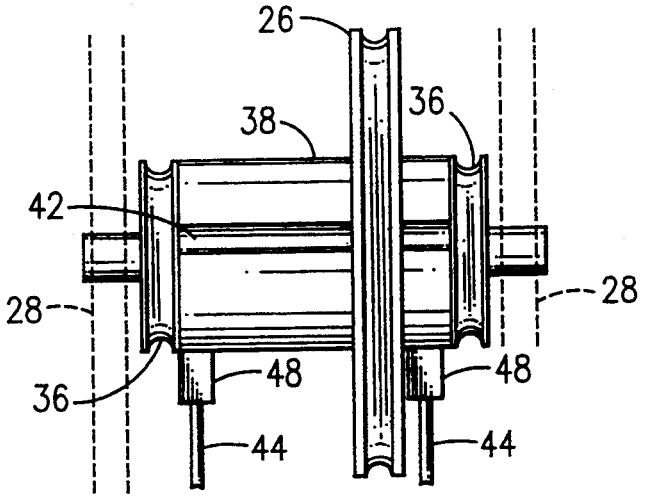
FIG. 4 is a front view of a synchronizing pulley of this embodiment.

A shown in FIG. 4, a cam cable 34 is provided for each of the upper and lower limbs, and rides in grooves 36 in the outer ends of the hub 38 of the synchronizing pulley 26. The cam cable extends outward and also rides in cam grooves 40 in the periphery of the respective cam plates 22, as shown in FIG. 3. Ends of the cam cable are reeved in the cam plates 22. A center part of the cable 34 passes through an axial passageway 42 in the hub 38 that connects the two end grooves 36. The cable 34 is not reeved to the synchronizing pulley 26. This construction ensures equal tension on the cable 34 on both the right and left sides, so that the flexing of the power limb 16 is fore-end-aft only, without twisting.

Figure 5:
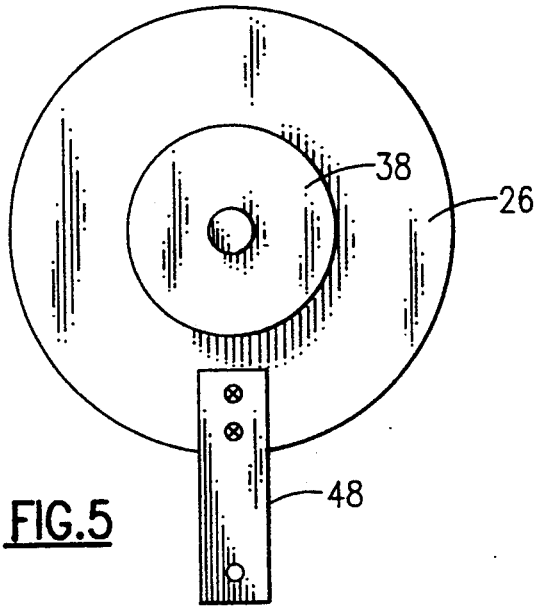
FIG. 5 is a side view of the synchronizing pulley of this embodiment.

A reflex cable 44 has one end affixed onto a fixed point 46 on the cam pulley 20, and has another end attached to a rigid bar 48 that projects radially from the synchronizing pulley 26 (see also FIG. 5). The bar 48 can be disposed centrally on the pulley 26, or there can be a pair of bars 48 on the ends of the pulley 26 so that the associated cable or cables 44 does not twist the outer limb 18. Alternatively, the one end of the reflex cable 44 could be affixed to a point on the rigid outer limb 18.

In this embodiment, when the bowstring 24 is drawn, the outer limb 18 and cam pulley 20 rotate to the position shown in FIG. 2. The cam pulley 20 winds the cable 34, and rotates the synchronizing wheel 26. The bar 48 pulls the reflex cable 44 downward, i.e., towards the riser 12, and this pulls the cam 20 downwards towards the riser, flexing the power limb 16. The power limb then supplies energy for the flight of the arrow, and pulls the rigid limb 18 back to the upright position when the bowstring 24 is released.

The shape of the cam plates 22, the size and position of the bar 48, and the position of the fixed point 46 all combine to determine the draw weight characteristic of the bow. The draw characteristic of the bow 10 is programmable by selecting cam plates 22 of suitable profile. In possible variations of this embodiment, cam inserts (not shown) can be placed on the cam plates 22 to alter the cam profile. This permits field programming of the bow, e.g. for reduced full draw weight, or to accommodate arrows of different weights or lengths.

Figure 6:
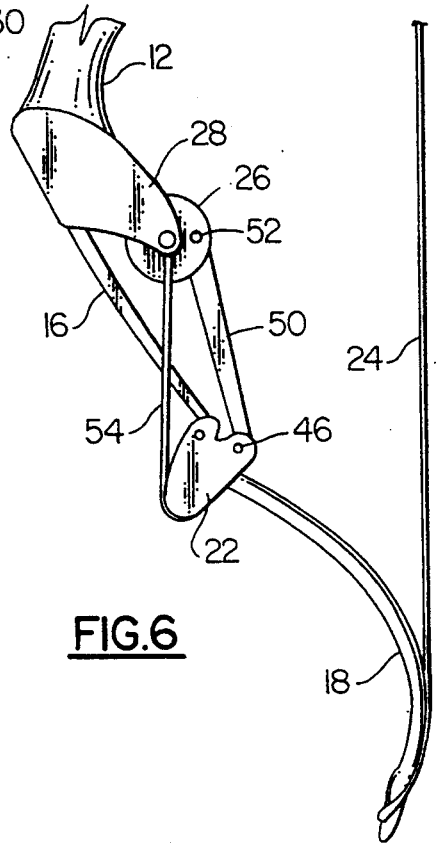
FIG. 6 is a partial side elevation of a lower limb portion of a compound bow of an alternative embodiment.

A second embodiment of the bow of this invention will be described with reference to FIG. 6. Those elements of this embodiment that are shown in the FIG. 1 embodiment will be identified with the same reference numerals, and will not be described in detail again.

Here a rigid linkage member or rod 50 is used in place of the reflex cable, and is pivoted on the fixed point 46 of the cam pulley 20. An inner end of the rod 60 is attached to a pivot 52 on the associated synchronizing pulley 26. A pair of cam cables 54 are employed at each end of the riser 12, although only the left side cable 54 of one pair is shown here. The cam cable 54 is affixed at one end to the end protuberance 28 of the riser 12, and rides on the associated cam plate 22, into which it is reeved. The synchronizing pulleys 26 function as described before.

In this embodiment, drawing the bowstring 24 rocks the outer limb 18 and the attached cam pulley 20, and the rigid rod 50 rotates the synchronizing pulley 26. Also, as the outer limb 18 rotates, the cables 54 ride in the grooves of the cam plates 22, shortening the distance to the riser 12, and thus imposing flexion on the associated power limb 16.

As with the previous embodiment, the draw weight characteristic can be programmed by selecting a suitable profile of the cam plates 22.

Alternative embodiments can be constructed with the cam pulleys 20 disposed to the belly side, rather than oriented towards the back side as shown here. Also, the rod or rigid linkage member 50 can be pivoted to the back side of the synchronizing pulley 26. The synchronizing pulleys 26 can alternatively be positioned behind the power limb 16, rather than the belly side, as shown.

The power limb 16 is an elongated spring member, preferably formed of a composite material of good elasticity and a high spring constant.

While the bow of this invention has been described with reference to selected preferred embodiments, it should be recognized that the invention is not strictly limited to those embodiments. Rather many modifications and variations are possible without departure from the scope and spirit of this invention, as defined in the appended claims.

I claim:

1. An archery bow comprising a riser having an upper end and a lower end, upper and lower limbs each having an inboard end affixed respectively to the upper and lower ends of said riser, a bowstring connecting outboard ends of said upper and lower limbs, and synchronizing means for ensuring equal flexing of said upper and lower limbs upon draw and release of said bowstring; each of said upper and lower limbs including a spring limb member having an inboard end affixed to the respective end of said riser, and an outboard end;

a cam pulley pivotally mounted on the outboard end of the respective spring limb member;

a rigid limb member having an inboard end fixed to said cam pulley and an outboard end to which said bowstring is attached;

a flexible inextensible cable extending from the respective end of said riser passing over a periphery of said cam pulley with an end thereof attached to said cam pulley; and a link member coupled between a point fixed with respect to said cam pulley and said synchronizing means to move said synchronizing means with movement of said cam pulley.

2. An archery bow according to claim 1 wherein said spring limb members are cantilevered from respective ends of the riser.

3. An archery bow according to claim 1 wherein said synchronizing means includes upper and lower synchronizing wheels pivotally mounted in respective ends of said riser, and a synchronizing cable passing through said riser and over each of said synchronizing wheels.

4. An archery bow according to claim 3 wherein each said link member includes a rigid connection rod connected at one end to the associated synchronizing wheel and at another end to the associated cam pulley.

5. An archery bow according to claim 3 wherein said synchronizing wheel has a rim thereon for receiving an inboard portion of said inextensible cable, so that rotation of said cam pulley produces a corresponding rotation of the synchronizing wheel.

6. An archery bow according to claim 5 wherein each said link member includes a reflex cable extending between the associated cam pulley and synchronizing wheel.

7. An archery bow according to claim 6, wherein said synchronizing wheel includes a protruding arm on which said reflex cable is attached.

8. An archery bow according to claim 3 wherein said synchronizing wheel has left and right rims at axially spaced locations, and a passage in a hub of said synchronizing wheel; said cam pulley includes right and left members having respective rims thereon of substantially identical shape; and said inextensible cable has a right end affixed in the cam pulley right member and a left end affixed in the cam pulley left member, the inextensible cable passing from its right end over the rim of the right pulley member, over the right rim of the synchronizing wheel, through said passage, over the left rim of the synchronizing wheel, and over the rim of said cam pulley left member to said left end.

* * * * *